US006854146B2

(12) United States Patent
Stoyles et al.

(10) Patent No.: US 6,854,146 B2
(45) Date of Patent: Feb. 15, 2005

(54) METHOD FOR PRODUCING DIGITALLY DESIGNED CARPET

(75) Inventors: Richard W. Stoyles, LaGrange, GA (US); Sequin Angelique Baker Hernandez Rubio, Spartanburg, SC (US); Elizabeth Woods Walters, LaGrange, GA (US); Clint A. Samples, Carrollton, GA (US)

(73) Assignee: Milliken & Company, Spartanburg, SC (US)

( * ) Notice: Subject to any disclaimer, the term of this patent is extended or adjusted under 35 U.S.C. 154(b) by 100 days.

(21) Appl. No.: 09/877,477

(22) Filed: Jun. 8, 2001

(65) Prior Publication Data

US 2002/0034607 A1 Mar. 21, 2002

Related U.S. Application Data

(60) Provisional application No. 60/211,110, filed on Jun. 12, 2000.

(51) Int. Cl.[7] ..... D06F 1/00; G06F 19/00
(52) U.S. Cl. ..... 8/150; 700/133
(58) Field of Search ..... 8/150, 158, 149; 68/205 R; 700/133, 134, 135

(56) References Cited

U.S. PATENT DOCUMENTS

| | | | | |
|---|---|---|---|---|
| 3,894,413 | A | 7/1975 | Johnson | 68/205 R |
| 3,942,343 | A | 3/1976 | Klein | 68/205 R |
| 4,033,154 | A | 7/1977 | Johnson | 68/205 R |
| 4,034,584 | A | 7/1977 | Klein et al. | 68/205 R |
| 4,116,626 | A | 9/1978 | Varner | 8/149 |
| 4,132,817 | A | 1/1979 | Tillotson | 427/244 |
| 4,141,231 | A | 2/1979 | Kudlich | 68/205 |
| 4,170,883 | A | 10/1979 | Varner | 68/205 |
| 4,174,395 | A | 11/1979 | Beguin | 424/251 |
| 4,286,003 | A | 8/1981 | Higgins et al. | 428/95 |
| 4,309,881 | A | 1/1982 | Kimble | 68/205 R |
| 4,336,753 | A | 6/1982 | Vidalis | 101/127 |
| 4,341,098 | A | 7/1982 | Otting | 68/205 |
| 4,434,632 | A | 3/1984 | McCollough, Jr. et al. | 68/205 R |
| 4,501,038 | A | 2/1985 | Otting | 8/151 |

(List continued on next page.)

FOREIGN PATENT DOCUMENTS

| | | |
|---|---|---|
| EP | 0 057 513 | 8/1982 |
| EP | 0 123 367 | 10/1984 |
| EP | 0 306 568 | 3/1989 |
| EP | 0 449 411 | 10/1991 |
| FR | 2 271 878 | 12/1975 |
| GB | 2 022 017 | 12/1979 |
| GB | 2 042 422 | 9/1980 |
| WO | 81/01161 | 4/1981 |

*Primary Examiner*—Frankie L. Stinson
*Assistant Examiner*—Joseph L Perrin
(74) *Attorney, Agent, or Firm*—Terry T. Moyer; Daniel R. Alexander

(57) ABSTRACT

Exciting new optically engaging and controversial three dimensional simulating illusionary digital designs which generate emotional responses and photo-realism shock effects are produced by digitally creating a design or pattern and dying and/or printing the digitally created design using digitally controlled dying or printing equipment on flooring, such as, modular carpet tiles, area rugs, runners, rugs, carpets, floor mats, or the like. In accordance with the preferred embodiment of the present invention, a carpet tile substrate is cut into individual carpet tile blanks which are jet injection dyed with digitally created designs, colors, patterns, and/or the like which provide excellent seamability, look, feel, wear, and allow for true or accurate registration of three dimensional like, complex, complicated, intricate designs heretofore unknown in the carpet industry.

2 Claims, 17 Drawing Sheets

(11 of 17 Drawing Sheet(s) Filed in Color)

U.S. PATENT DOCUMENTS

| | | | | |
|---|---|---|---|---|
| 4,517,813 | A | | 5/1985 | Eggebrecht et al. ..... 62/284 |
| 4,522,857 | A | | 6/1985 | Higgins ..... 428/95 |
| 4,547,921 | A | | 10/1985 | Otting et al. ..... 8/151 |
| 4,574,413 | A | | 3/1986 | Otting et al. ..... 8/149.1 |
| 4,576,020 | A | | 3/1986 | Thurman et al. ..... 68/205 |
| 4,576,665 | A | | 3/1986 | Machell ..... 156/72 |
| 4,584,854 | A | | 4/1986 | King ..... 68/205 R |
| 4,655,784 | A | | 4/1987 | Rahman ..... 8/148 |
| 4,676,078 | A | | 6/1987 | Ramsey ..... 68/205 |
| 4,766,745 | A | | 8/1988 | Johnston et al. ..... 68/200 |
| 4,849,768 | A | | 7/1989 | Graham ..... 346/1.1 |
| 4,905,592 | A | | 3/1990 | Sorel ..... 101/123 |
| 5,035,018 | A | * | 7/1991 | Robbins et al. ..... 8/150 |
| 5,142,481 | A | | 8/1992 | Cox ..... 364/470 |
| 5,179,749 | A | | 1/1993 | Magee ..... 8/150 |
| 5,228,161 | A | | 7/1993 | Scatizzi ..... 8/151 |
| 5,404,158 | A | | 4/1995 | Carlotta et al. ..... 347/32 |
| 5,425,389 | A | | 6/1995 | Johnson, Jr. ..... 137/1 |
| 5,948,500 | A | | 9/1999 | Higgins ..... 428/95 |
| 6,001,137 | A | | 12/1999 | Alfekri et al. ..... 8/445 |
| 6,203,881 | B1 | | 3/2001 | Higgins ..... 428/95 |

* cited by examiner

*FIG. —1—*

METHOD FOR PRODUCING DIGITALLY DESIGNED CARPET

CROSS-REFERENCE TO RELATED APPLICATION

This application claims priority to and the benefit of U.S. Provisional Application No. 60/211,110 filed Jun. 12, 2000 and the contents of which are incorporated by reference as if fully set forth herein.

TECHNICAL FIELD

The present invention relates to floor coverings and more particularly to digitally designed and produced carpet materials incorporating precisely applied designs, colors, patterns and the like facilitating accurate registration of complex intricate designs on cooperating floor covering elements.

BACKGROUND OF THE INVENTION

A recently occurring trend has been the desire to incorporate designs of increasing complexity and three-dimensional appearance into interior spaces. Floor coverings such as carpet, carpet tiles, area rugs, runners, and like interior design elements have long been recognized as having the ability to substantially influence the appearance and character of an interior space. The design incorporated within such floor covering materials may be used to reflect a theme within the space as well as to convey a desired aesthetic impression. Due to the influence of emerging technology as an element of day to day life, designs reflective of technological themes including complex patterning and the like are believed to be highly desirable.

Technology, linked with exceptionally good design, is an emerging trend of ever increasing importance. Good design is an important element of market growth. Technology advancements permit the useful and practical implementation of such desirable design features.

The desire for designs of ever increasing complexity in floor covering materials has in the past been hampered by the practical ability to apply complex designs in a truly consistent and highly reproducible manner such that element to element variations are imperceptible thereby permitting two or more separate elements to be arranged in a manner which appears substantially continuous. The difficulty of obtaining such perceived continuity has heretofore been found to be particularly problematic when using complex designs and/or designs of three-dimensional character. While the problem may be addressed by using simple repetitive patterns, such products may not be desirable to all users. Accordingly, it is generally desired to have more exciting interiors.

With the development of technology, there has been a corresponding increase in the ability of individuals to become more expressive. This in turn has translated into greater expectations regarding day-to-day experiences. At the same time, consumers expect goods to have added value. Of paramount importance are good aesthetics, which are being achieved even though there is a significant trend to lower manufacturing cost. In order to meet these expectations, designers are more multi-tasked than ever before in an effort to bring new design philosophies to every day consumable items while nonetheless maintaining affordability.

The following rules and tools reflect this emerging design philosophy.

New Millennium Rules and Tools:

❖Designs and colors should be mixed, not matched.

❖The only rule is: there are no rules as long as you don't keep it simple.

❖Create dazzling, daring, inspirational, exciting and the unexpected in design.

❖It's time for the design world to be audacious and take "Xtreme" risks.

❖Designs can be naive—loosely drawn or sketched, reflecting a certain innocence or frivolous approach.

❖Use counter change in pattern and in color.

❖Make circles of all kinds and scales—indicative of the importance of communications.

The application of such rules and tools has led to the following major emerging design themes.

Hyper-Reality

Optically engaging and controversial; three-dimensional, illusionary digital expressions; designs that generate pure emotional responses; designs to fill "empty" spaces; fantastic reality; and photo-realism "shock" effects.

Colors: Ice Blue, Cerulean, Scarlet, Charred Indigo, Mustard, Blued Grey, White, Daffodil, Olive, Old Magnolia, Gold Moss, Periwinkle and Thunder Grey.

Techno Pop

Uninhibited creation and freedom of expression; super-scale designs; explosive, technology-influenced patterns; bold and symbolic; and dot-com looks.

Colors: Dramatic Brights, Primary-Secondary-Tertiary Orange and Gold.

Industrial Chic

Heavy metal, hard-edged metallic looks; industrial age-inspired concepts; and 3-D effects that can disturb or excite the senses. Expect the unexpected.

Colors: Black, Grey, Pewter, Silver, Beige, Copper and Bronze.

Surface Tension

Intriguing surfaces that enhance the fascination of real and tactile or illusory textures; crumpled weaves; hombre stripes; distorted weave effects; interplay of conflicting elements; and sensual vision—designs that are more than skin deep and exemplify the sensations of luxury and lightness without the associated costs.

Colors: Neutrals, Beiges, Greys, Olive, Lilac, Coffee Tones, and colors that emphasize the look of texture.

Organic Origins

Based on nature's environment and "life-giving" cell structures; stones, leaves and water; and investment in the future.

Colors: Nature's Colors—all kinds of Greens and Blues, but generally more Autumn-inspired and Earth Pigments.

Ecostyle

Natural fiber inspirations and dried grasses. This Ecostyle theme provides desired stability to all the other themes—imparting balance and harmony in our lives. Raffia effects, coir, ramie, abaca, sisal.

Colors: Cafe au lait, Warmed Milk, Putty Gold, Beiges and a hint of Claret.

SUMMARY OF THE INVENTION

In order to address the above-described desire for floor covering designs incorporating ever more diverse and complex patterns and color schemes, the present invention provides advantages and alternatives over the prior art by providing the digital creation of such patterns in conjunction with the ability to precisely apply such patterns to floor covering materials in a consistent and repeatable manner thereby providing accurate registration of patterns upon installation substantially without the appearance of discontinuity.

According to one feature, the present invention provides pattern creation through the technology of the Millitron Digital Dye Injection Process utilizing up to about 52 million computer commands per second. The designs are dazzling, daring, inspirational and exciting as well as celebrating the unexpected in modular carpet design.

According to another feature, the present invention facilitates the development and utilization of designs that embrace the major design trends including by way of example, Hyper-Reality, Techno Pop, Industrial Chic, Surface Tension, Organic Origins and Ecostyle as described above.

BRIEF DESCRIPTION OF THE DRAWINGS

This application contain at least one drawing executed in color.

FIG. 15 is a cut-away view of a tufted carpet with a cushioned composite structure.

FIG. 16 is a cut-away side view of a bonded carpet incorporating a cushioned composite structure.

FIG. 17 is a cut-away side view of a tufted carpet incorporating a potentially preferred structure.

FIG. 18 is a cut-away side view of a bonded carpet incorporating a potentially preferred structure.

FIG. 19 is a cut-away side view of an alternative embodiment of a tufted carpet having no reinforcement layer.

FIG. 20 is a cut-away side view of an alternative embodiment of a bonded carpet having no reinforcement layer.

FIG. 21 is a cut-away side view of an alternative structure for a tufted carpet.

FIG. 22 is a cut-away side view of an alternative structure for a bonded carpet.

Figure 1:
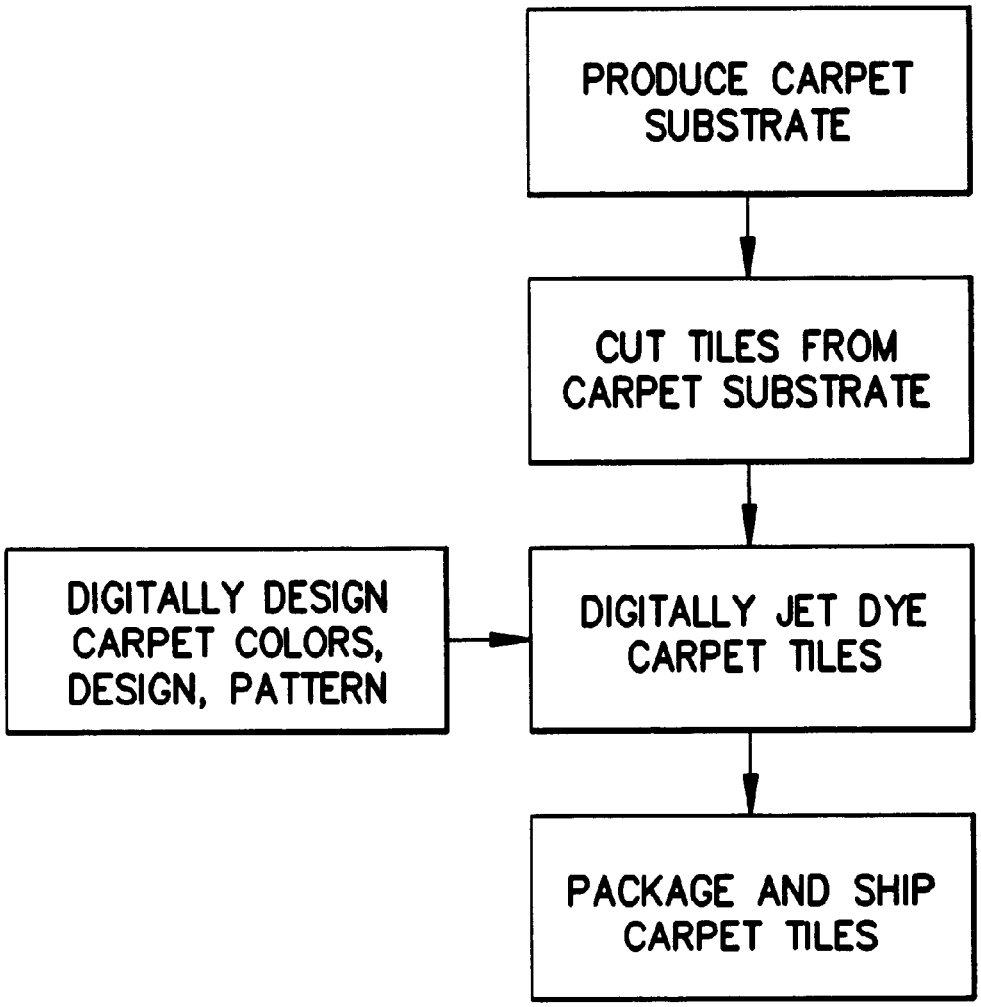
FIG. 1 is a schematic view illustrating an overall process in accordance with one embodiment of the present invention.
Figure 2:
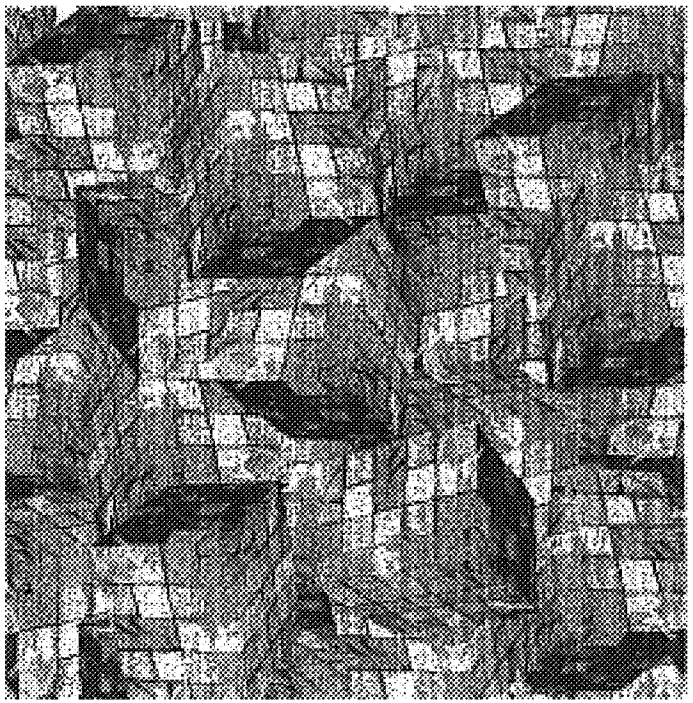
FIGS. 2–14 are schematic top views representing exemplary carpet tiles having designs which are, for example, jet injection dyed on a cut piece of cushion back carpet tile substrate to produce a finished dyed, printed, and/or patterned carpet tile. Such cushion back carpet tiles have excellent seamability, registration, look, feel, wear, comfort, and can have a three dimensional like appearance or design.
Figure 3:
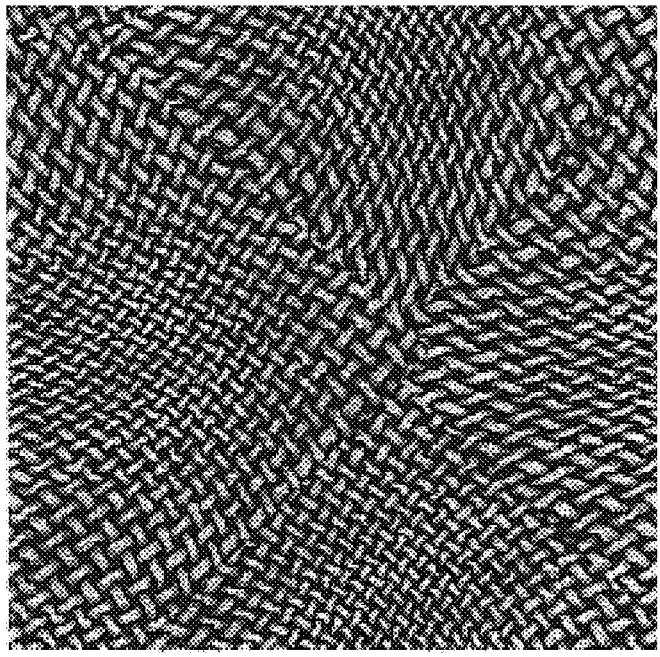
Figure 4:
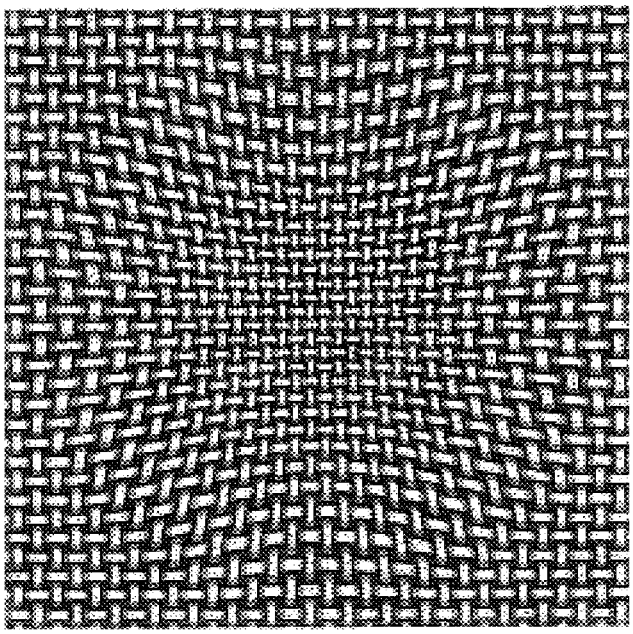
Figure 5:
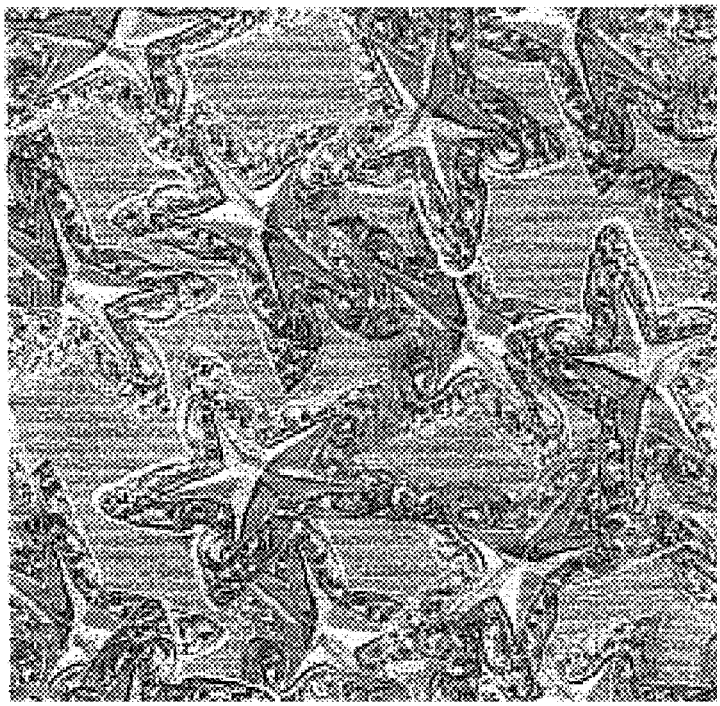
Figure 6:
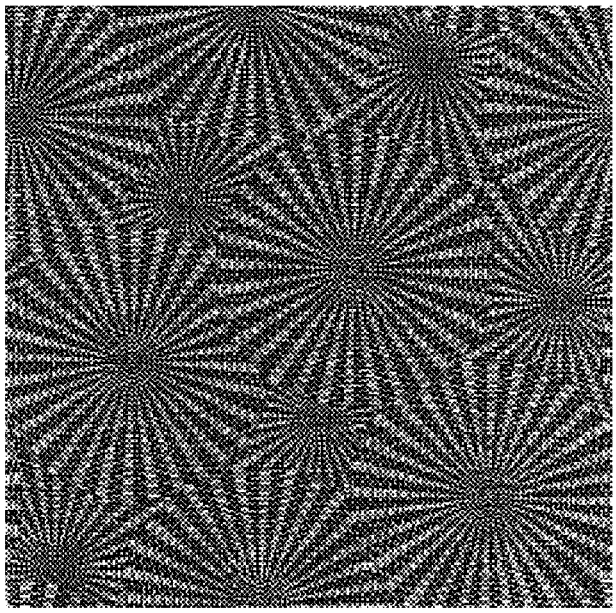
Figure 7:
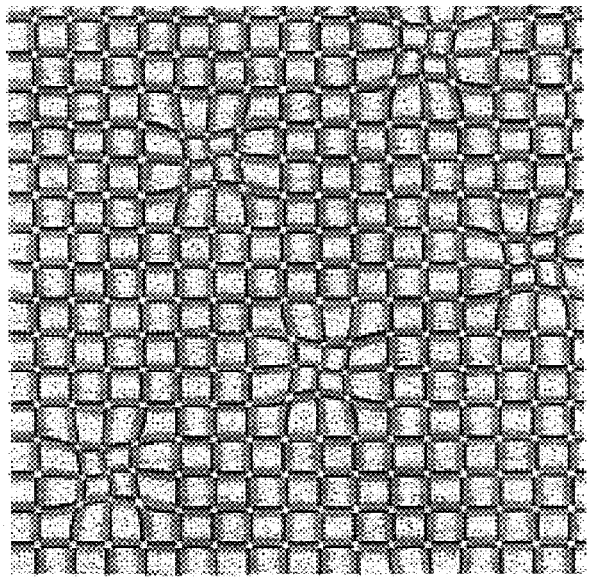
Figure 8:
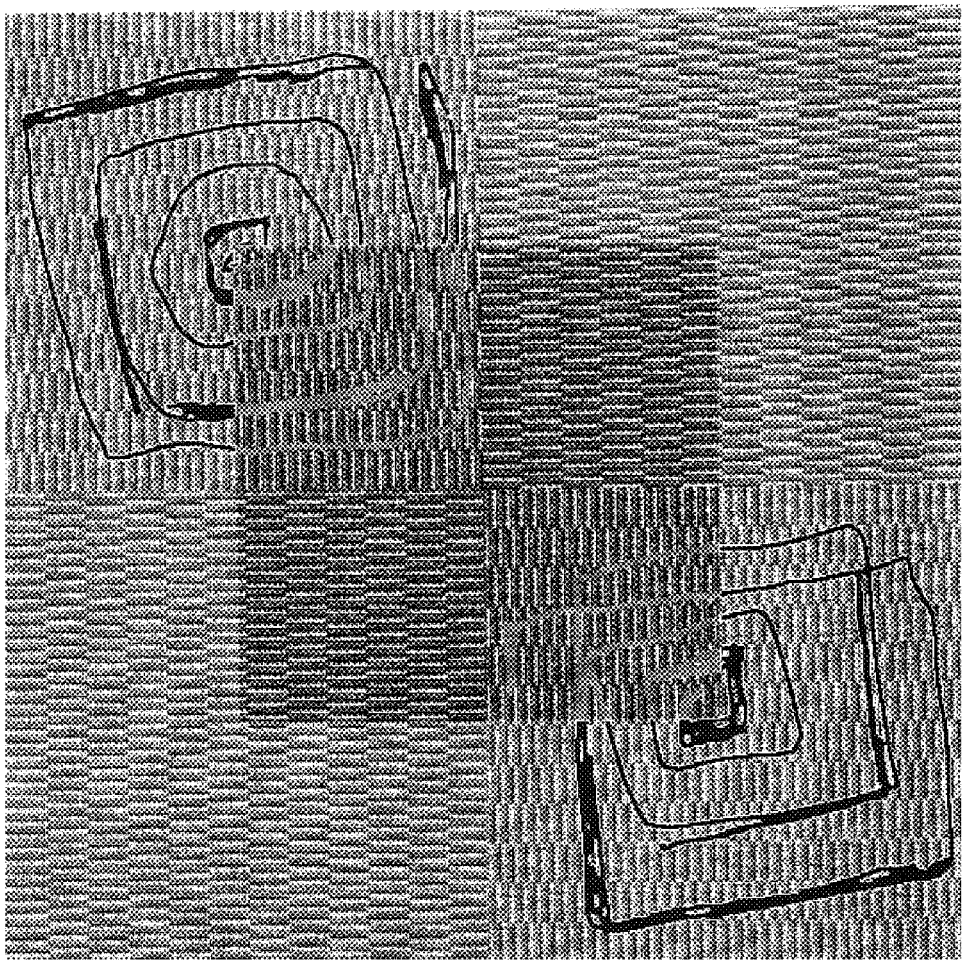
Figure 9:
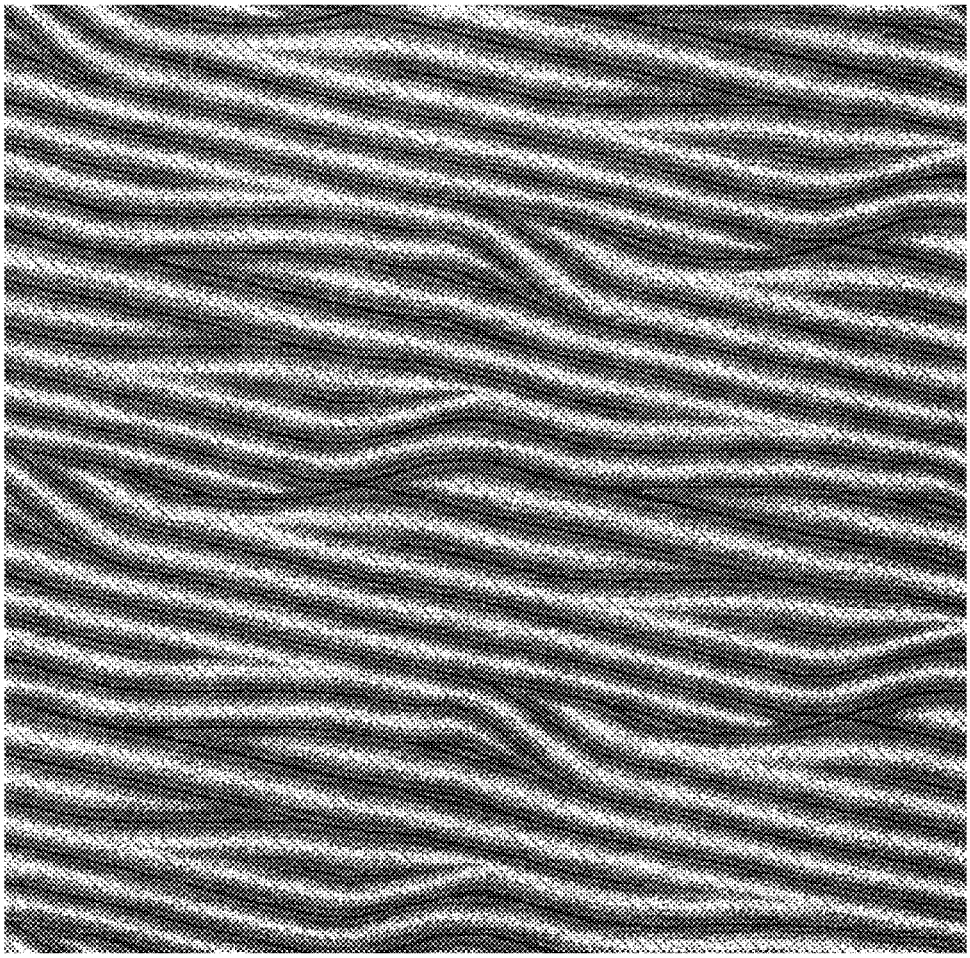
Figure 10:
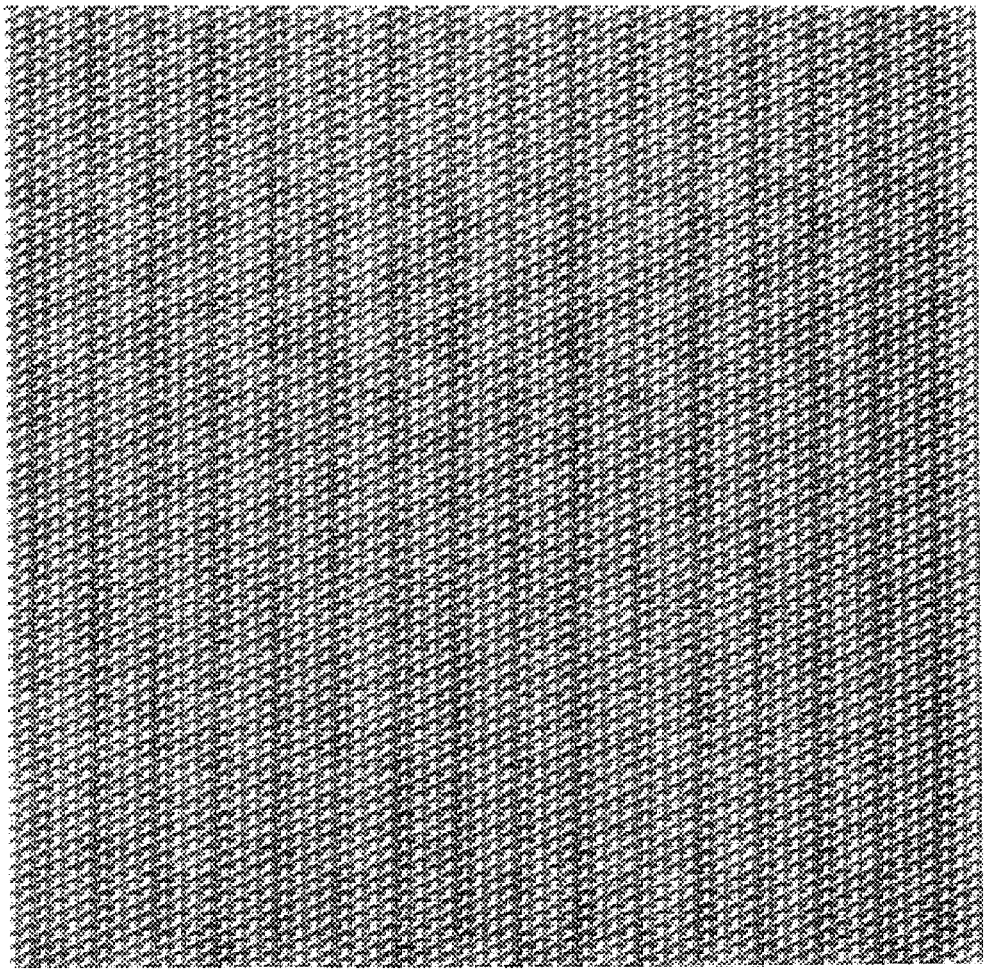
Figure 11:
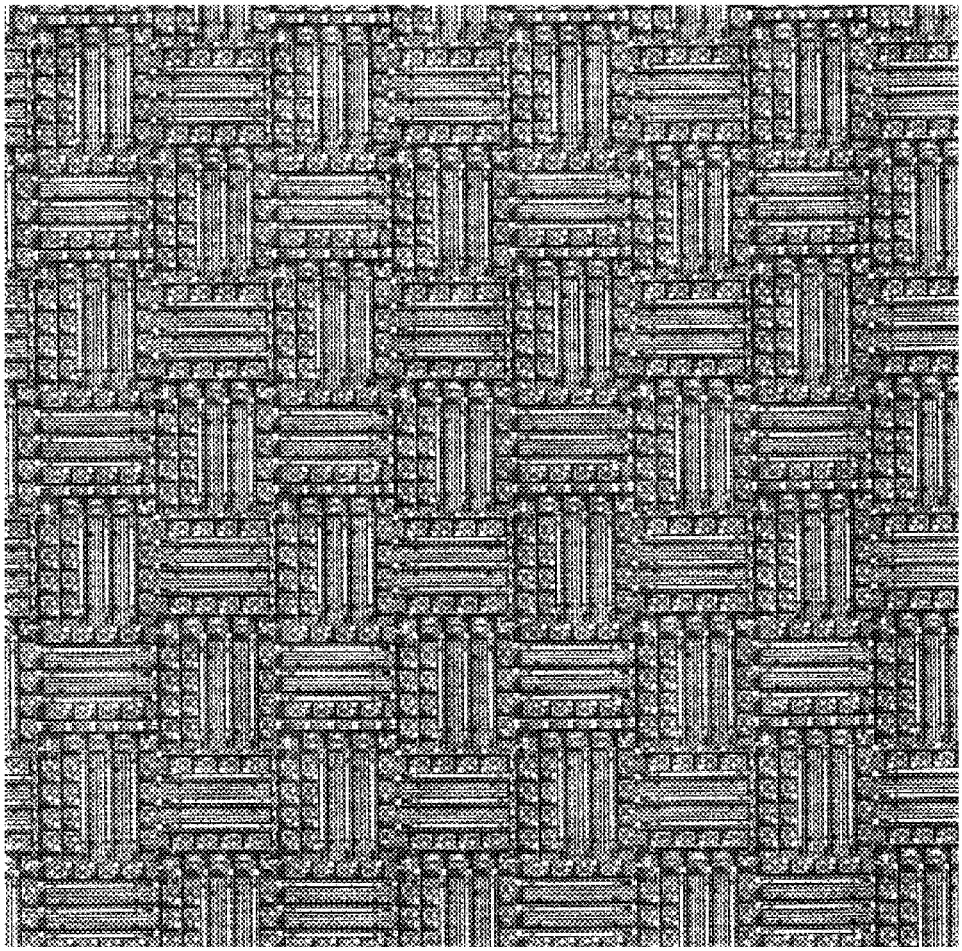
Figure 12:
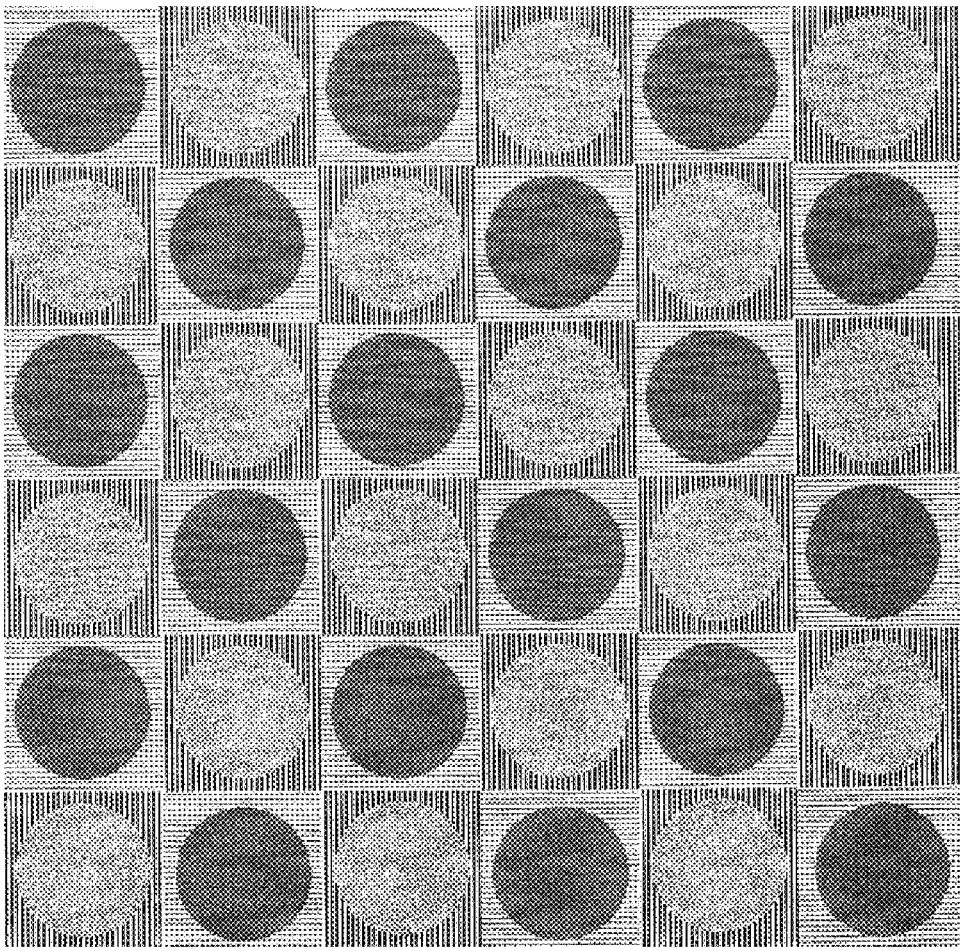
Figure 13:
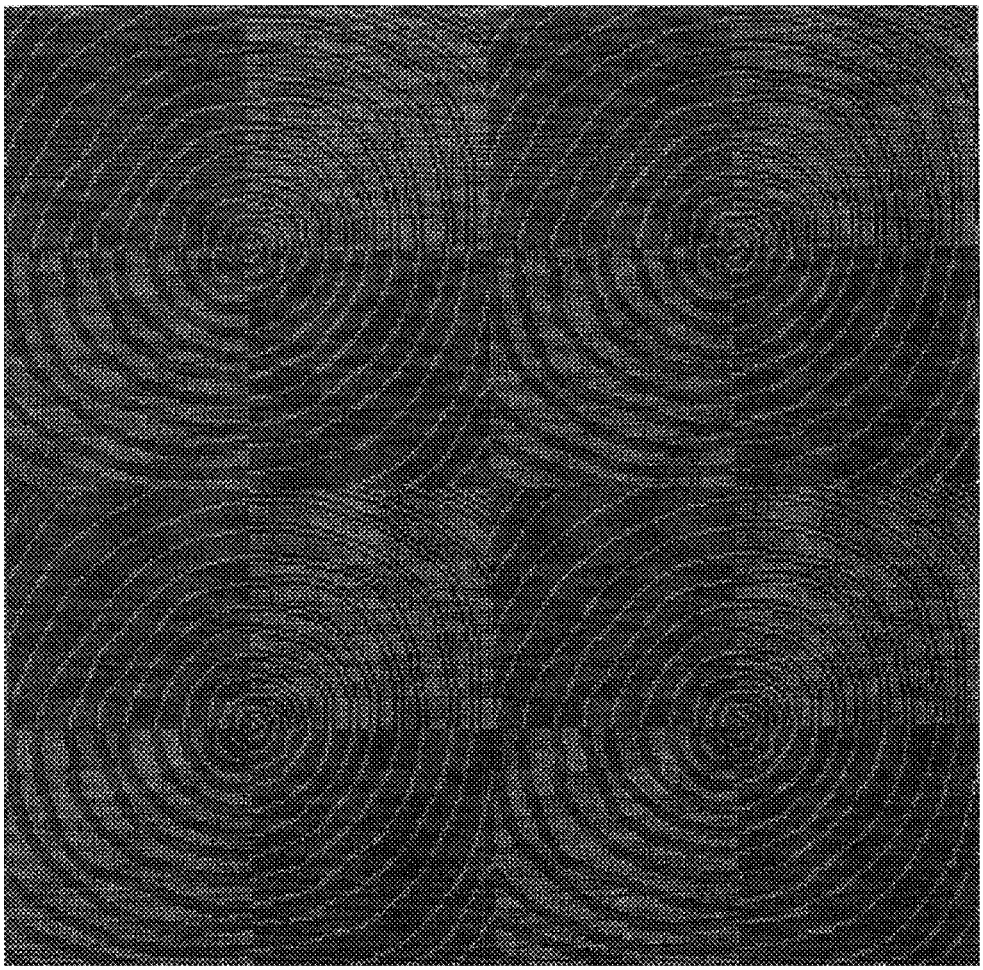
Figure 14:
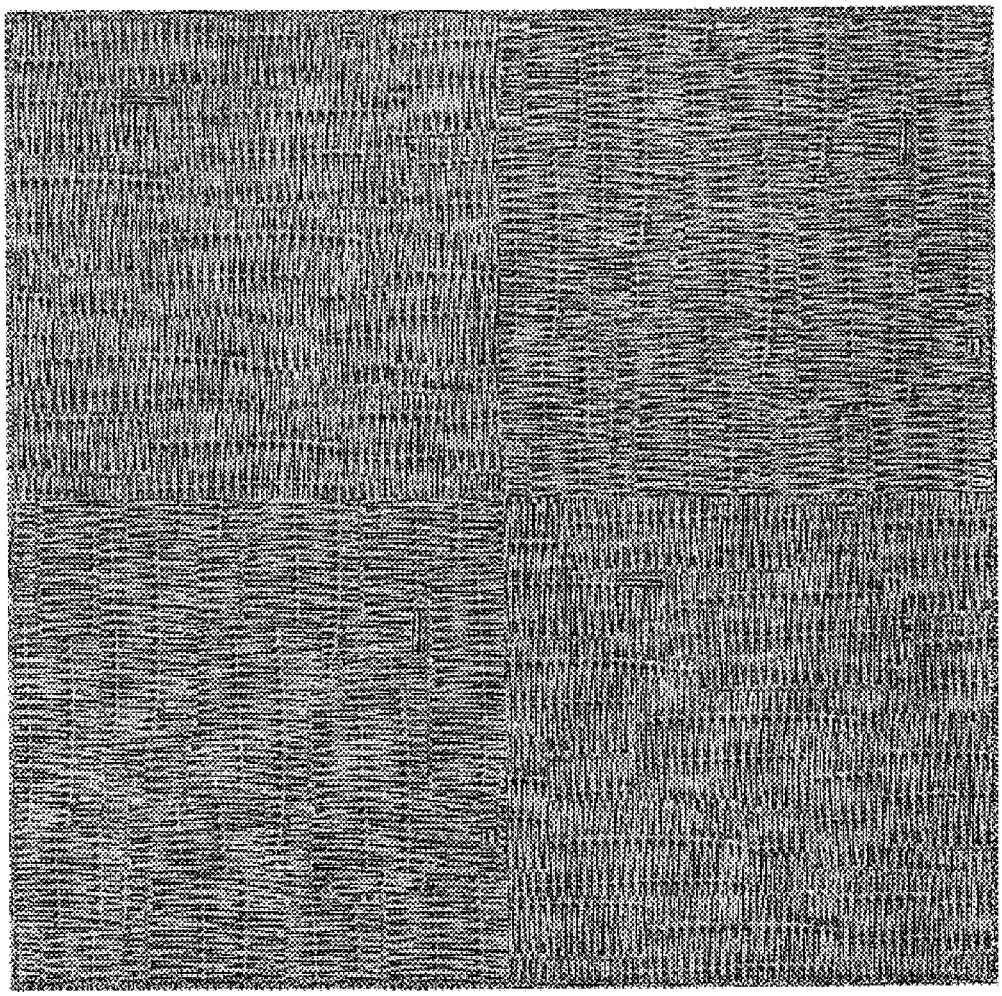

In accordance with at least one aspect of the present invention, three Dimensional (3-D) looking designs are produced on flooring such as, modular carpet tile, broadloom, area rugs, runners, floor mats, rugs, carpet, or the like. Preferably the 3-D simulating designs are produced by digital design processes using computers and digital design software which develop a digital design file which is fed to a digitally controlled dying or printing apparatus, for example jet dying, jet injection dying, transfer printing, or the like. It is preferred to use a Millitron jet dye injection machine marketed by Milliken & Company of LaGrange, Ga. Nevertheless, one could use other dying or printing machines.

Many techniques are known for the application of dyestuffs to textile substrates, and particularly the application of dyestuffs to such substrates in a pattern configuration. Among such techniques, it has been found advantageous to apply dye in the form of discrete streams of dye, formed and directed by a plurality of dye-emitting orifices. Ideally, each individual stream may be intermittently interrupted or diverted in accordance with pattern information. Dyeing systems of this latter type are generally described in greater detail in, for example, U.S. Pat. Nos. 3,894,413, 3,942,343, 4,033,154, 4,034,584, 4,116,626, 4,309,881, 4,434,632, and 4,584,854, hereby incorporated by reference.

These systems are commonly configured in the form of a conveyor which transports the substrate to be dyed under a plurality of such continuously flowing discrete dye streams.

In a preferred embodiment, a plurality of dye orifices, each directed at the substrate, are arranged in several individual linear arrays positioned generally above and across the substrate path in spaced, parallel alignment, with each array being associated with a separate source (e.g., a different color) of liquid dye. Generally, each of the arrays is positioned in close proximity to the substrate to be dyed, with typical clearance between the array and the substrate surface being substantially less than one inch. The individual continuously flowing dye streams in a given array are normally directed onto the substrate surface. However, by means of a transverse intersecting stream of diverting air which is aligned with each dye stream and which is actuated or interrupted in response to externally supplied pattern information, the continuously flowing stream may be directed into a collection chamber or catch basin so as to prevent any dye from contacting the substrate.

To accurately control the amount of dye applied to a given location on the material during the dyeing operation, and to insure that the dye strikes the material in a very small, precise spot, the lower portion of the collection chamber contains a collector plate supportably positioned in spaced relation above the lower wall of the collection chamber. This collector plate is adjustably attached to the lower wall of the collection chamber by way of an elongate collector plate support member which forms an extension of the lower wall of the collection chamber. By means of careful adjustment of the position of the collector plate relative to the collector plate support member, the leading edge of the collector plate can be accurately positioned relative to the dye discharge axes of the array to insure prompt and precise interception of the streams when deflected. Details of such a dyeing apparatus and collection chamber construction are described in U.S. Pat. No. 3,942,343, referenced above. As described therein, each dye stream, when deflected, passes across the edge of the collector plate and into the collection chamber. Upon removal of the deflecting air stream, the stream moves back across the plate edge and resumes its normal path of travel toward the material to be dyed.

Because each array may be supplied with a different dye stuff, dye of different colors from several of the individual arrays may be directed onto the same area of the substrate and blended on the substrate to produce a wide variety of colors and patterns.

Also, in accordance with the present invention, it is preferred to print the colors, designs, patterns, and/or the like onto a preformed or precut carpet tile blank or substrate (with or without a cushion back) so that the printing has excellent registration on each individual carpet tile. Hence, when the carpet tiles are laid adjacent one another the designs match substantially perfectly. If such carpet tiles are properly installed, a person looking at the laid flooring cannot tell where the tiles meet (or where there are seams).

In accordance with another aspect of the present invention, the carpet tiles are produced so the tiles can be installed monolithically rather than by quarter turn or parquet, ashler, or brick installation methods. A monolithic installation is preferred as a simpler installation technique which should be less expensive to the end user and one which provides for an aesthetically pleasing flooring.

It is heretofore unknown in the industry to digitally design carpet colors, designs, patterns, and/or the like, feed this digital design to a digitally controlled jet dye machine, and to dye or print, cut carpet tiles blanks or substrates with the digitally designed patterns, colors, designs, and/or the like with excellent registration and seamability so that the resultant carpet tiles can be installed monolithically and have designs or patterns which are complex, stripes, lines, three dimensional looking designs, and/or combinations thereof.

In accordance with another aspect with the present invention the entire process is digitally driven in that the design, selection, and creation is digital, the ordering of the design or product can be digitally implemented on the internet or local area network, the manufacture, dying, and printing are digitally controlled, and the packaging, shipping, transportation, and delivery of the end product can be digitally controlled via computerized systems.

With reference to FIG. 1 of the drawings, an exemplary process in accordance with the present invention includes the steps of producing a carpet or carpet tile substrate with or without cushion backing, cutting the carpet or carpet tile substrate into tiles, area rugs, runners, or the like, digitally jet dying, injection dying, printing, or the like digitally designed carpet colors, designs, and/or patterns thereon, and then packaging and shipping the completed carpet tiles, rugs, area rugs, floor mats, runners, or the like to the respective customer or customers.

With reference to FIGS. 2–14 of the drawings, selected embodiments or examples of carpet tile with digitally designed carpet designs, colors, patterns, and/or the like show the three dimensional like appearance which is possible, the variety of colors, designs, and patterns, the complexity of the design, and patterns, and the like which far surpass earlier flooring designs. In the past, carpet or flooring suppliers avoided complex patterns, stripes, and the like because of registration and seam problems between modular carpet tiles. In accordance with the present invention, complex designs are possible as the registration of designs or patterns on adjacent carpet tiles is very accurate. Also, the customer cannot detect the seams between adjacent carpet tiles when the tiles are laid monolithically.

In accordance with one example of the present invention, the designs or patterns can be printed or dyed onto the carpet substrate or blank in a dot pattern of, for example, 10×10 Dots Per Inch (DPI), 20×20 DPI, 40×40 DPI, 60×60 DPI, or the like. Such dot patterns provide a high resolution which adds to the design quality, the seamability and the enhanced appearance of the product.

The exemplary designs, patterns, colors, arrangements, and the like of the present invention not only are aesthetically pleasing, but in the new digital age of the new Millennium offer a digital impact which can inspire, motivate, and exhilarate customers, employees, and the like. Architects and designers around the world will be inspired by the possibilities afforded by the present invention.

Although the present invention is especially adapted for producing high quality cushion back carpet tiles having excellent seamability, appearance, aesthetics, consumer appeal, and the like, it is to be understood that the present invention may be adapted to the production of other products, such as other flooring, wall covering, art, and the like. For example, the techniques and designs may be applied to textile, fabrics, ceramic tile, vinyl flooring, counter tops, wallpaper, paneling, and the like.

With reference to FIGS. 15–22 of the drawings, the carpet tile of the present invention may take a variety of forms and be either a tufted or bonded loop or cut pile construction with or without a cushion backing, a reinforcing layer, or the like. It is preferred that it be a cushion back carpet tile such as the Comfort Plus® or Quattra™ modular carpet tile produced by Milliken & Company of LaGrange, Ga.

FIGS. 15–22 of the drawings correspond to FIGS. 1A–6B of U.S. Pat. No. 5,948,500 hereby incorporated by reference. Although the present invention is not limited to a particular construction, it is preferred that the carpet tile have the construction shown for example in FIGS. 17–22 of the drawings.

As described in U.S. Pat. No. 5,948,500, the cushioned carpet comprises a primary carpet having a primary base and a plurality of pile-forming yarns projecting outwardly from one side. A layer of reinforcement material is bonded to the primary base on the side opposite the pile forming yarns. The reinforcement layer is adjacent to and embedded in, a cushion layer of a polymer such as a polyurethane. There is preferably no additional adhesive between the cushion layer and the layer of reinforcement material since the primary carpet fabric is mated in-situ to the polyurethane-forming composition without preheating the polyurethane-forming composition. An apparatus and process for forming the cushioned carpet fabric of the present invention are also described.

Figure 15:
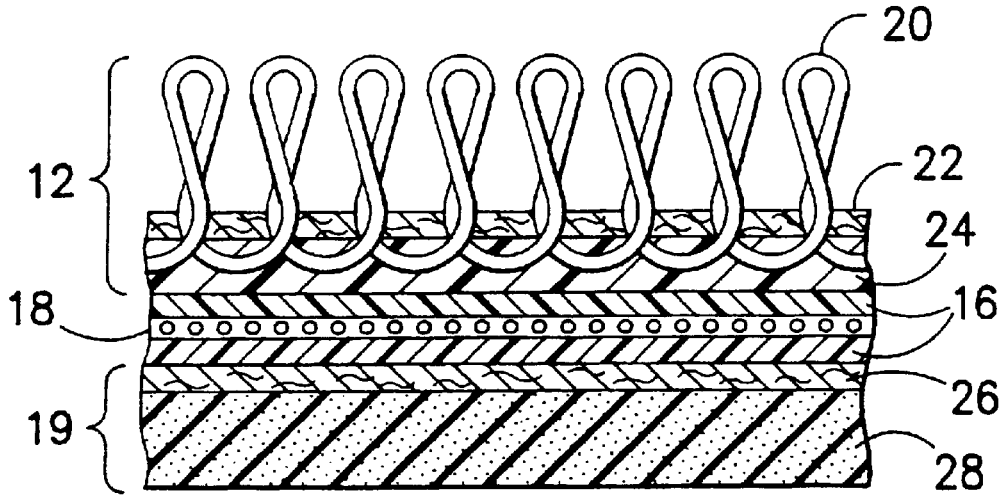
FIGS. 15–22 are schematic cross-section representations of carpet tile constructions in accordance with selected embodiments of the present invention.
Figure 16:
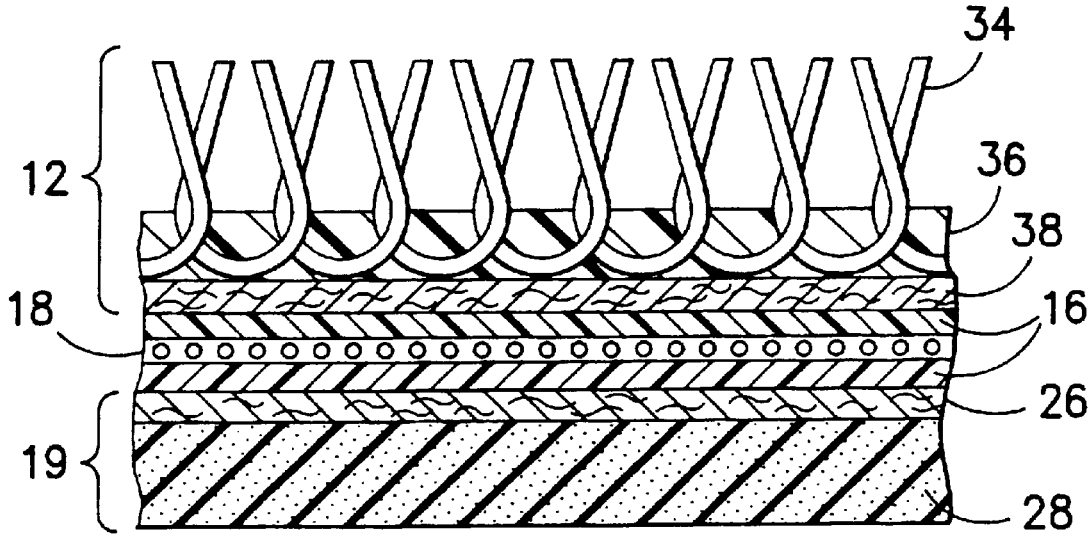
Figure 17:
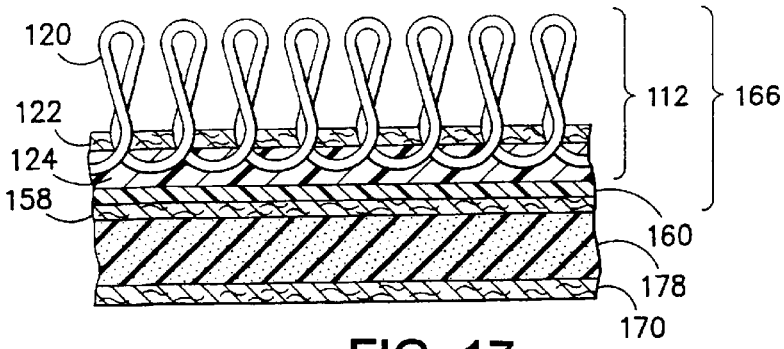
Figure 18:
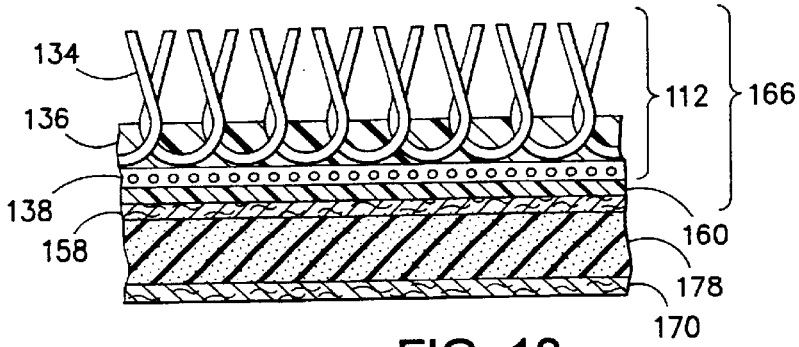

Carpet and carpet tiles having cushioned backings are well known to those of skill in the art. Such cushioned backed carpet is disclosed, for example in U.S. Pat. No. 4,522,857 (incorporated by reference). An example of a tufted carpet product is illustrated in FIG. 15 and an example of a bonded carpet product is illustrated in FIG. 16 herein.

In the tufted carpet, a primary carpet fabric 12 is embedded in an adhesive layer 16 in which is embedded a layer of glass scrim or nonwoven material. A foam base composite 19 is likewise adhesively bonded to the adhesive layer 16. In the tufted carpet illustrated in FIG. 15, the primary carpet fabric 12 includes a loop pile layer 20 tufted through a primary backing 22 by a conventional tufting process and held in place by a precoat backing layer of latex 24 or other appropriate adhesive including a hot melt adhesive or the like. The foam base composite 19 of the prior art tufted carpet product preferably includes an intermediate layer 26 molded to a layer of urethane foam 28 as illustrated.

The bonded carpet (FIG. 16) employs the same type of foam base composite 19 adhesively bonded by adhesive laminate layers 16. However, the primary carpet fabric 12 has somewhat different components from that of the tufted product in that it preferably comprises cut pile yarns 34 implanted in a PVC, latex, or hot melt adhesive 36 having a woven or nonwoven reinforcement or substrate layer 38 of fiberglass, nylon, polypropylene or polyester.

The practice utilized in forming the product disclosed in the U.S. Pat. No. 4,522,857 patent and other known products involves preforming and curing the foam based composite 19 of urethane foam and backing material by practices such as are disclosed in U.S. Pat. Nos. 4,174,395 4,132,817 and 4,517,813, to Tillotson (all incorporate by reference). Only after this foam base composite is formed and cured to some degree as a modular component, is it laminated to the carpet base.

As will be appreciated, the cost associated with such modular formation and assembly practices may be reduced by a simplified operation in which a primary carpet fabric, either with or without a stabilizing layer of scrim or the like, is laid directly into a polyurethane-forming composition and thereafter curing the polyurethane. The process can be made even more efficient if the polyurethane-forming composition requires no pre-curing prior to joining the carpet base.

The known processes directed to the application of the polyurethane cushioned backings to fabric substrates have relied on the extremely close control of temperature in both the polyurethane composition and the adjoined fabric layer to effect stability through pre-cure of the polyurethane prior to lamination of the primary carpet to form a composite structure. Such pre-cure has been largely considered necessary in order to yield a stable foam structure to which the primary carpet backing could be applied. The application of heat to the polyurethane composition prior to joinder of the heated fabric backing causes polymer cross linking which has heretofore been thought to be necessary to stabilize the foam mixture to a sufficient degree to prevent the collapse of the foam.

There is also described a particularly simple composite structure amendable to insitu formation of a stable cushion carpet composite. Specifically, a single process could be used to bring all layers of the cushioned carpet composite together by laying a primary carpet fabric, either with or without some degree of preheat, directly into a mechanically frothed polyurethane-forming composition prior to curing the polyurethane and without an intermediate layer of material.

As indicated, the prior art carpet forming processes typically required the separate formation of a foam base composite comprising a backing layer and a layer of urethane foam. The backing layer and a layer of urethane foam. The backing layer is then used as an intermediate layer to which a primary carpet fabric reinforcing layer can be adhesively bonded.

Alternatively, the base of the primary carpet fabric is adhesively bonded to a layer of nonwoven glass reinforcement material to form a preliminary composite. A puddle of polyurethane-forming composition is simultaneously deposited across a nonwoven backing material. The preliminary composite and the polyurethane-forming composition are thereafter almost immediately brought together with the preliminary composite being laid into, and supported by, the polyurethane-forming puddle. The entire structure is then heated to cure the polyurethane forming composition. The preliminary composite may be slightly heated to about 120° F. to improve heating efficiency although the process may likewise be carried out without such preheating.

It is to be understood that the primary carpet fabric may have different embodiments, the component structure of the primary carpet fabric is not critical to the present invention. Rather it is intended that any primary carpet fabric having a pile-forming portion and a primary base may be utilized as the primary carpet fabric. By "primary base" is meant any single layer or composite structure including, inter alia, the commonly used layered composite of primary backing 212 and latex precoat 24 previously described in relation to the prior are tufted product (FIG. 15) and the adhesive layer 36 with reinforcement substrate 38 previously described in relation to the prior art tufted product (FIG. 16). As will be appreciated, the use of polyester in the primary base structure may be desirable due to the eventual heat curing such structure may undergo. Other embodiments as may occur to those of skill in the art may, of course, also be utilized. For example, in the bonded product, the pile forming yarns could be heat tacked to substrate 38 to permit simplified construction of a primary carpet.

Alternative embodiments including those disclosed in U.S. Pat. No. 4,576,665 to Machell (incorporated by reference) may likewise be utilized. For example, it is contemplated that specialized primary backings such as nonwoven structures comprising fiberglass sandwiched between layers of polyester may be utilized in the primary tufted carpet to impart the desired properties relating to stability thereby potentially reducing or even eliminating the need for the latex pre-coat presently utilized. Moreover, it is contemplated that if a pre-coat is to be utilized, it may be added directly in-line in an operation prior to any adhesive operation.

With regard to the presently preferred embodiment, in the tufted carpet of the present invention (FIG. 17), the primary carpet fabric 112 preferably comprises a loop pile layer 120 of pile-forming yarns tufted into a primary backing 122 as is well known and held in place by a precoat of latex or hot melt adhesive 124. It is contemplated that the latex or hot melt adhesive may be added in-line after removal from the carpet roll prior to the application of any other adhesive as described below. The carpet may be steamed after addition of the pre-coat to facilitate subsequent printing operations if desired to reduce stresses.

In the bonded carpet of the present invention (FIG. 18), the primary carpet fabric 112 preferably comprises a plurality of cut pile yarns 134 implanted in a latex or hot melt adhesive 136 which is laminated to a reinforcement or substrate layer 138 of a woven or nonwoven material including fiberglass, nylon, polyester or polypropylene. It is contemplated that this substrate layer 138 may be pre-coated with latex or other thermoplastic polymers to permit melting adhesion with the cut pile yarns 134 upon the application of heat, thereby potentially reducing or eliminating the need for the latex or hot melt adhesive 136.

The yarns 120, 134 may be either spun or filament yarns and are preferably formed from a polyamide polymer such as nylon 6 or nylon 6,6 available from DuPont Fibers in Wilmington, Del., although other suitable natural or synthetic yarns may likewise be employed as will be recognized by those of skill in the art. By way of example only and not limitation, other materials which might be used include polyesters such as polyethylene terephthalate (PET), and polybutylene terephthalate (PBT); polyolefins, such as polyethylene and polypropylene; rayon; and polyvinyl polymers such as polyacrylonitrile.

In the tufted product, the adhesive pre-coat 124 is preferably SBR latex but other suitable materials such as PVC, EVA, acrylic, and hot melt adhesives as are well known to those of skill in the art may likewise be utilized. In the event that a hot melt adhesive is utilized, it is contemplated that a reinforcement material such as a glass scrim could be directly attached to form a composite laminate without the use of adhesives. Moreover, as previously indicated, it is contemplated that the adhesive pre-coat 124 may be entirely eliminated in the tufted product if the loop pile 120 is tufted in suitably stable relation to the primary backing 122.

In the potentially preferred practice, the primary carpet fabric 112 is conveyed by means of a plurality of rolls through an accumulator to a reinforcement bonding unit. Simultaneously with the conveyance of the primary carpet fabric 112 to the reinforcement bonding unit, a sheet of reinforcement material 158 is likewise conveyed to the reinforcement bonding unit. The reinforcement material 158 is preferably fiberglass nonwoven material although alternative materials may include woven glass, woven polyester, nonwoven glass, and nonwoven polyester.

At the reinforcement bonding unit, an adhesive 160 (FIGS. 17, 18) such as a hot melt adhesive is preferably applied to the reinforcement material 158 by means of a film coater or other such unit as are well known. The reinforcement material 158 and the primary carpet fabric 112 are thereafter preferably passed in mating relation between joining members such as rolls thereby bonding the reinforcement material 158 to the underside of the primary carpet fabric 112. That is, the reinforcement material 158 is bonded on the side of the primary carpet fabric 112 from which the pile forming yarns do not project. The bonding of the reinforcement material 158 to the underside of the primary carpet fabric produces a preliminary composite 166 which is thereafter laid into a puddle of a polyurethane-forming composition as described below.

Although the reinforcement bonding unit is preferably a film coater, it is to be understood that alternative equivalent means such as application rolls, spray headers and the like may also be utilized. By way of example only, and not limitation alternative means for the application of adhesive 160 are disclosed in U.S. Pat. No. 4,576,665 to Machell.

In the preferred practice, while the preliminary composite is being formed, a backing material 170 such as a nonwoven backing is passed through a scray to a polymer application unit which preferably includes a polymer discharge unit and a doctor blade. The backing material 170 is coated with a polymer 178 such as a polyurethane-forming composition as disclosed more fully below.

In the preferred embodiment, the backing material 170 is an 80% polyester, 20% polypropylene nonwoven fibrous material which is available from Spartan Mills Company in Spartanburg, S.C. While this represents the backing material of preference, it is to be understood that any number of alternative compositions may likewise be utilized as dictated by requirements regarding shrinkage and installation. By way of example only, in instances where very little or no shrinkage may be tolerated, the backing material may be up to 100% polyester. Further, while a nonwoven backing material may be preferred, it is contemplated that either woven or non-woven constructions may be utilized as can materials other than the polyester/polypropylene mix such as nylon, fiberglass and the like. The thickness of the backing material 170 can vary in the range of from about 0.01 inches to about 0.19 inches, although a range of between about 0.05 inches and 0.12 inches may be preferred.

As indicated, in the preferred practice the polymer application unit applies a deposit of a polymer 178 (FIGS. 17, 18) to the backing material 170 after which the height of the polymer is doctored to a desired level. In the preferred practice, the polymer applied is a polyurethane-forming composition based on a so called soft segment prepolymer of MDI (diphenylmethane diisocyanate) or an MDI derivative. The polyurethane-forming composition also preferably incorporates a silicone surfactant to improve both the frothability and stability of the polyurethane layer or "puddle" which is spread across the surface of the backing material 170.

The preferred polyurethane-forming composition for use in the present invention is disclosed in U.S. Pat. No. 5,104,693 to Jenkines the teachings of which are incorporated herein by reference.

Figure 19:
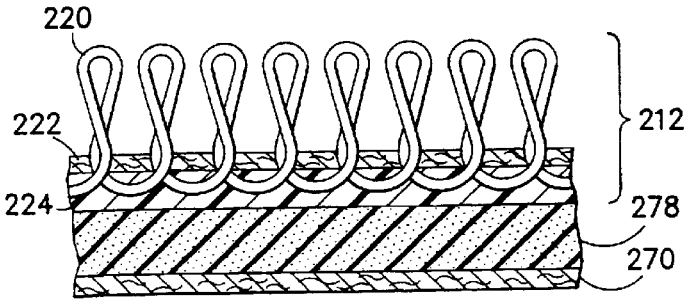
Figure 20:
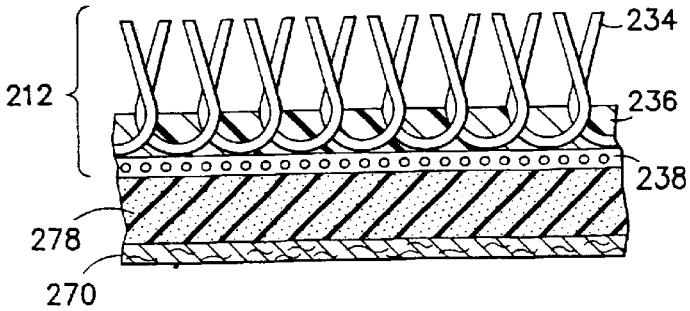

It will be appreciated that a number of alternative practices may be incorporated into the present invention yielding slightly different products. By way of example only, the reinforcement material 158 may be left completely out of the process thereby making the use of the adhesive application apparatus and adhesive 160 completely unnecessary. In such instances, the primary carpet fabric may be laid directly into the polyurethane-forming composition thereby yielding a composite structure as illustrated in FIGS. 19 and 20 with the polyurethane 278 immediately adjacent to the primary carpet fabric 212.

In yet another potential alternative, the backing 170, 270 may have an adhesive quick release backing attached to the face to which the polyurethane-forming composition is not applied. As will be appreciated, such a quick release backing will permit the carpet to be readily installed and removed without damaging the polyurethane cushion 178, 278. Moreover, it is contemplated that in some instances the backing 170, 270 might be completely eliminated such that the polyurethane cushion 178, 278 would directly contact the flooring as disclosed in relation to my U.S. Pat. No. 4,286,003 which is incorporated herein by reference.

Example I-Carpet Tile Construction

| | |
|---|---|
| Yarn | 28 Ounces per square yard nylon 6,6 loop pile continuous filament. |
| Primary Backing | 4 Ounces per square yard nonwoven polyester. |
| Pre-coat | 14 Ounces per square yard SBR Latex filled with 100 parts CaCO.sub.2. |
| Hot Melt Adhesive Laminate | 30 Ounces per square yard modified polypropylene. |
| Reinforcement | 3 Ounces per square yard nonwoven glass with acrylic binder. |
| Urethane Foam | 32 Ounces per square yard. |
| Urethane Foam Density | 16 Pounds per cubic foot. |
| Backing Material | 4 Ounces per square yard nonwoven (80% polypropylene, 20% polyester). |

In accordance with one aspect of the present invention, the carpet tile substrate or blank may be a refurbished or recycled carpet tile.

In accordance with one embodiment of the present invention, exciting new optically engaging and controversial three dimensional simulating illusionary digital designs which generate emotional responses and photo-realism shock effects are produced by digitally creating a design or pattern and dying and/or printing the digitally created design using digitally controlled dying or printing equipment on flooring, such as, modular carpet tiles, area rugs, runners, rugs, carpets, floor mats, or the like. In accordance a the preferred embodiment of the present invention, a carpet tile substrate is cut into individual carpet tile blanks which are jet injection dyed with digitally created designs, colors, patterns, and/or the like which provide excellent seamability, look, feel, wear, and allow for true or accurate registration of three dimensional like, complex, complicated, intricate designs heretofore unknown in the carpet industry.

Figure 21:
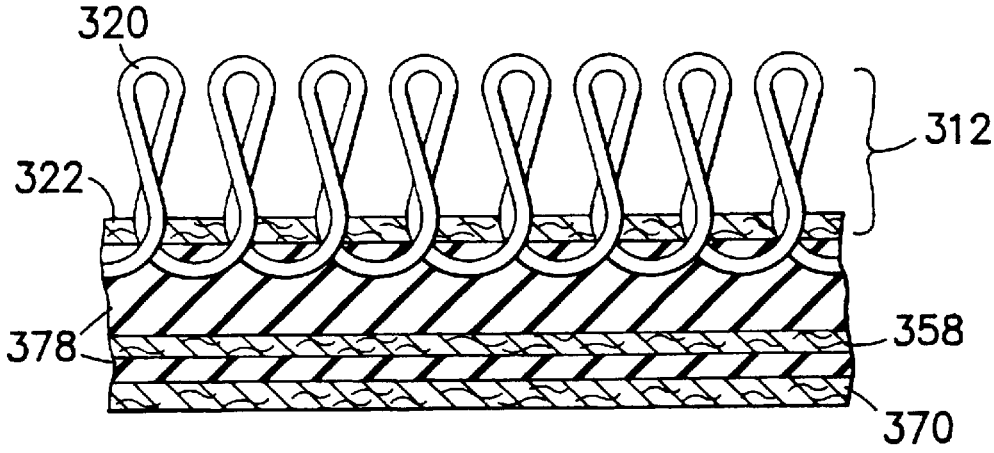
Figure 22:
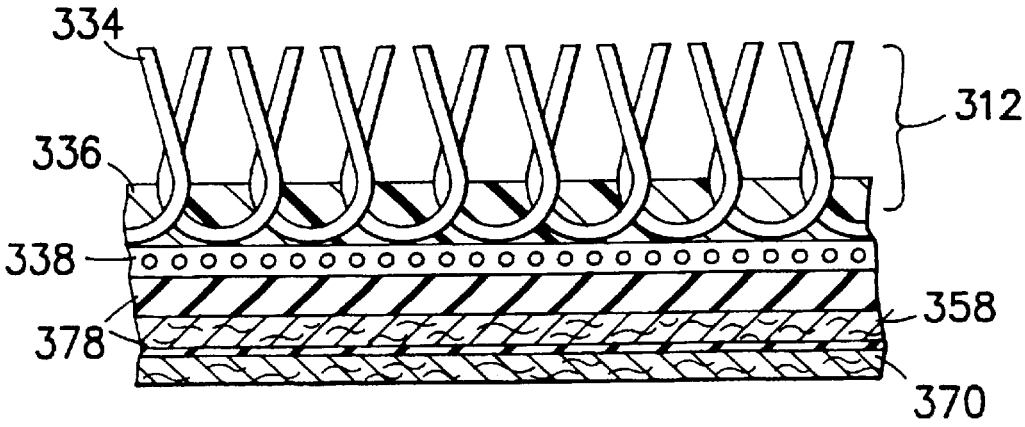

A potentially preferred configuration for a resulting tufted carpet composite is illustrated in FIG. 21. As illustrated, the reinforcement material 358 will be at least partially surrounded by, and embedded in, the polyurethane 378. As illustrated, it is contemplated that the layer of precoat may be eliminated in the tufted structure since the tufts may be held in place by the polyurethane 378. A potentially preferred configuration for a resulting bonded carpet composite is shown in FIG. 22.

It is, of course, to be appreciated that while several potentially preferred embodiments have been shown and described, the invention is in no way to be limited thereto, since modifications may be made and other embodiments of the principles of this invention will occur to those skilled in the art to which this invention pertains. Therefore, it is contemplated by the appended claims to cover any such modifications and other embodiments as incorporate the features of this invention within the true spirit and scope thereof.

What is claimed is:

1. A digitally based method of producing dyed or printed carpet tiles adapted to be installed in edge to edge relation, the method comprising the steps of digitally designing a digital carpet design for disposition across the carpet tiles, producing a carpet tile substrate and cutting individual carpet tile blanks from the carpet tile substrate and then digitally jet dyeing said digital carpet design on a plurality of carpet tile blanks, wherein the carpet tile blanks are cut from the carpet tile substrate prior to jet dyeing the carpet tiles and wherein the digital carpet design comprises at least one primary surface pattern including pattern portions disposed along edges of the carpet tiles such at the pattern portions of the surface pattern disposed along the edges of the carpet tiles are alignable to define a substantially seamless pattern interface between the carpet tiles when the carpet tiles are disposed in edge to edge relation without an underlying uniform subliminal pattern.

2. A digitally derived carpet tile produced by the method of claim 1 and having a digital carpet design comprising at least one primary surface pattern including pattern portions disposed along edges of the carpet tile such that the pattern portions of the surface pattern disposed along the edges of the carpet tile are alignable with pattern portions of adjacent carpet tiles to define a substantially seamless pattern interface between the carpet tiles when the carpet tiles are disposed in edge to edge relation without an underlying uniform subliminal pattern.

* * * * *